United States Patent [19]

Castelli et al.

[11] Patent Number: 4,844,214

[45] Date of Patent: Jul. 4, 1989

[54] ADJUSTABLE PORTFOLIO STRAP ARRANGEMENT

[75] Inventors: Renato Castelli, Gent; Willy Van Hoye, Zwijnaarde; Eric Sijmons, Oudenaarde, all of Belgium; Henri Morel, Maule; Jean M. Nowacki, Franconville, both of France

[73] Assignee: Samsonite Corporation, Denver, Colo.

[21] Appl. No.: 161,641

[22] Filed: Feb. 29, 1988

[51] Int. Cl.[4] ..... A45C 3/02

[52] U.S. Cl. ..... 190/103; 24/585; 190/900

[58] Field of Search ..... 190/100, 102, 103, 109, 190/900, 901, 902; 24/580–585

[56] References Cited

U.S. PATENT DOCUMENTS

| | | | |
|---|---|---|---|
| 318,369 | 5/1885 | Gottstein | 24/581 |
| 794,098 | 7/1905 | Hainsfurther | 24/584 |
| 2,536,169 | 1/1951 | Gray | 190/901 |
| 3,199,643 | 8/1965 | Korchmar | 190/102 |
| 3,608,158 | 9/1971 | Bengtsson . | |
| 4,265,286 | 5/1981 | Rapoport | 190/900 X |

OTHER PUBLICATIONS

Catalog, ITW Nexus, Copyright 1987, p. 22, "New Sewable Adjustment Tabs".

Sketch, "Baseball Cap Adjustment Strap", about Jan. 1988.

*Primary Examiner*—William Price

*Attorney, Agent, or Firm*—Gregory W. O'Connor

[57] ABSTRACT

The straps connecting the lid of a brief case and the outer panel of an expansible portfolio are adjustably connected to the outer panel through a track and buckle arrangement. The buckle is ordinarily locked in place on the track by a locking element spring urged into engagement with a complementary locking element on the track. A button connected to the buckle locking element allows the user to overcome the force of the spring and slide the buckle along the track to adjust the associated strap. The locking element and the spring are integrally formed components from a unitary molded plastic part which is carried by the buckle casing.

20 Claims, 3 Drawing Sheets

FIG. 1
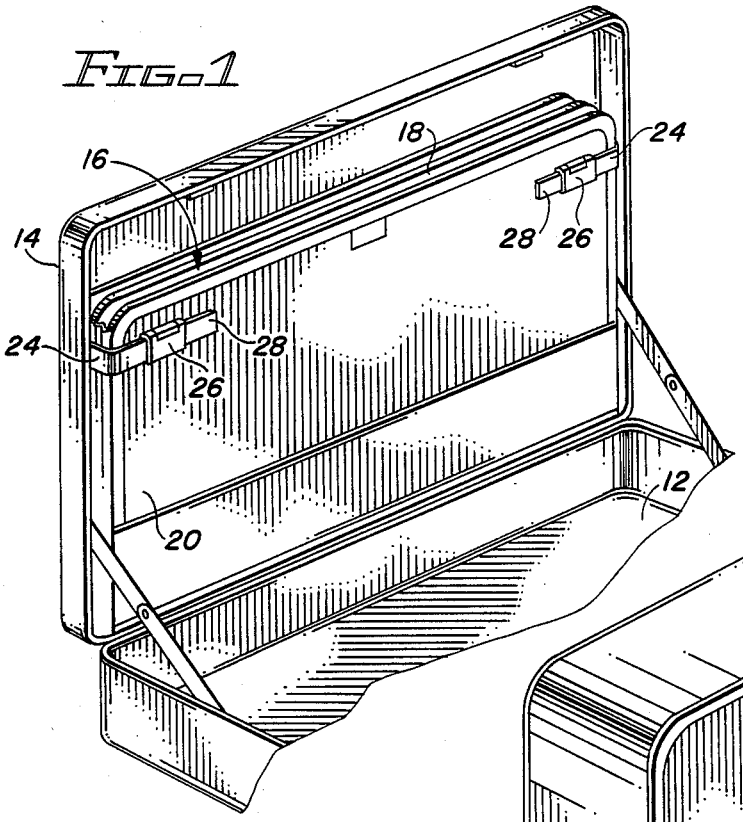
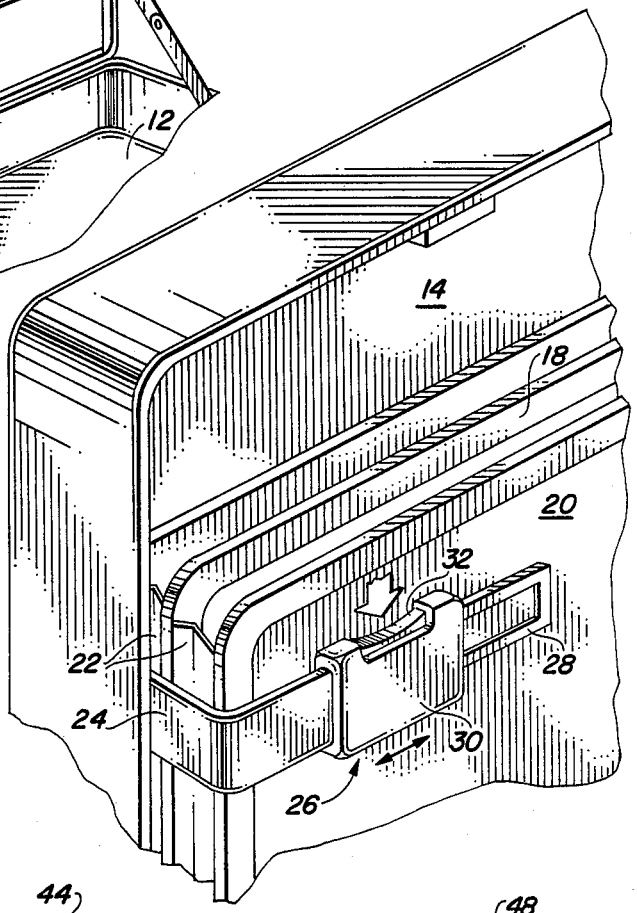
FIG. 2
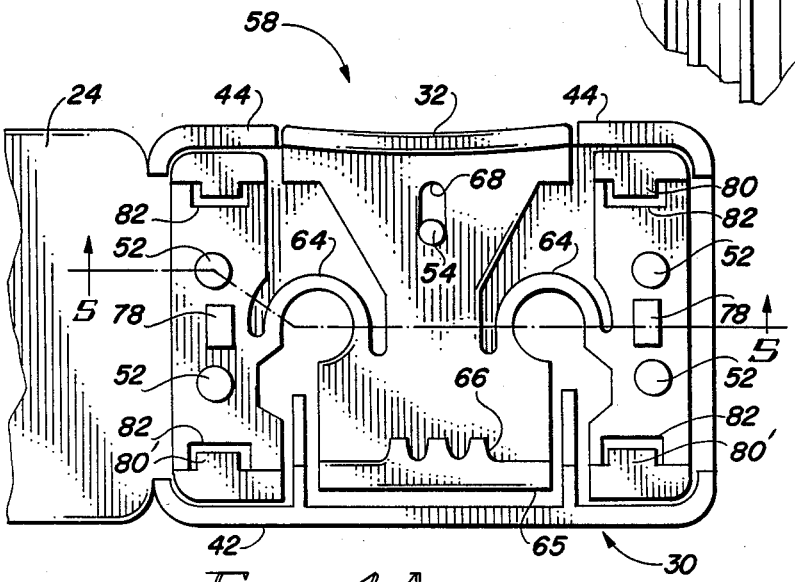
FIG. 4A
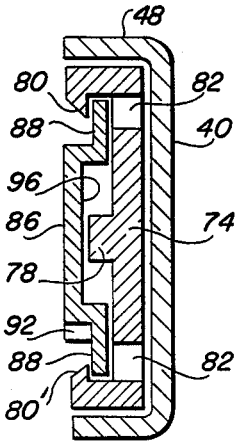
FIG. 9

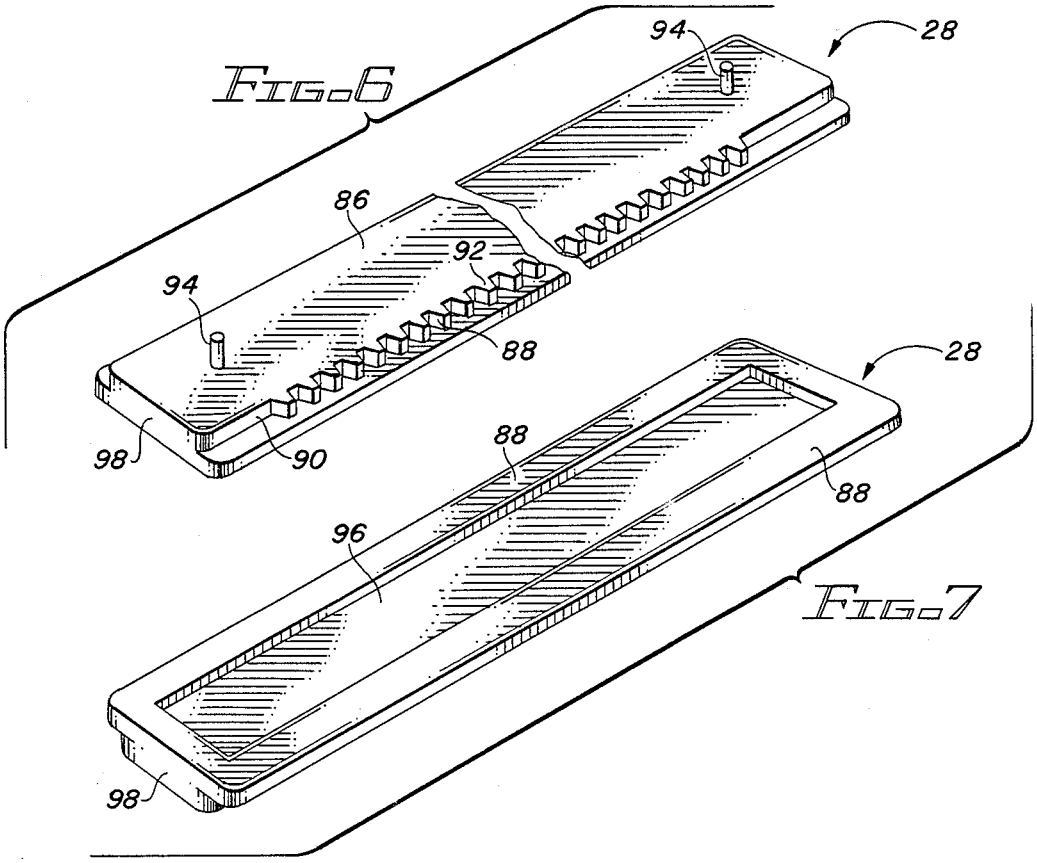
FIG. 6
FIG. 7
FIG. 8
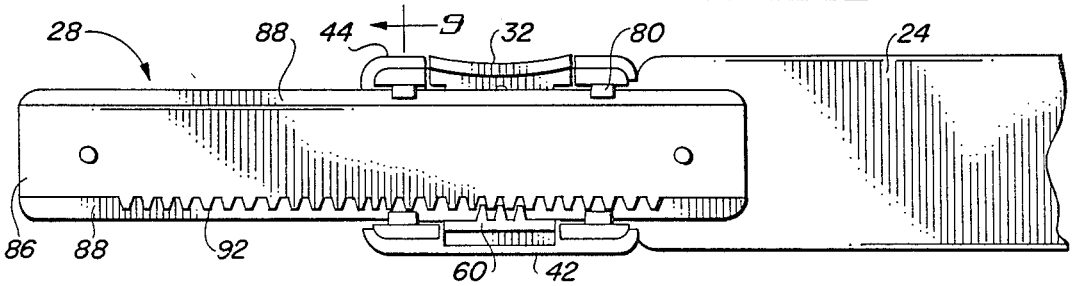
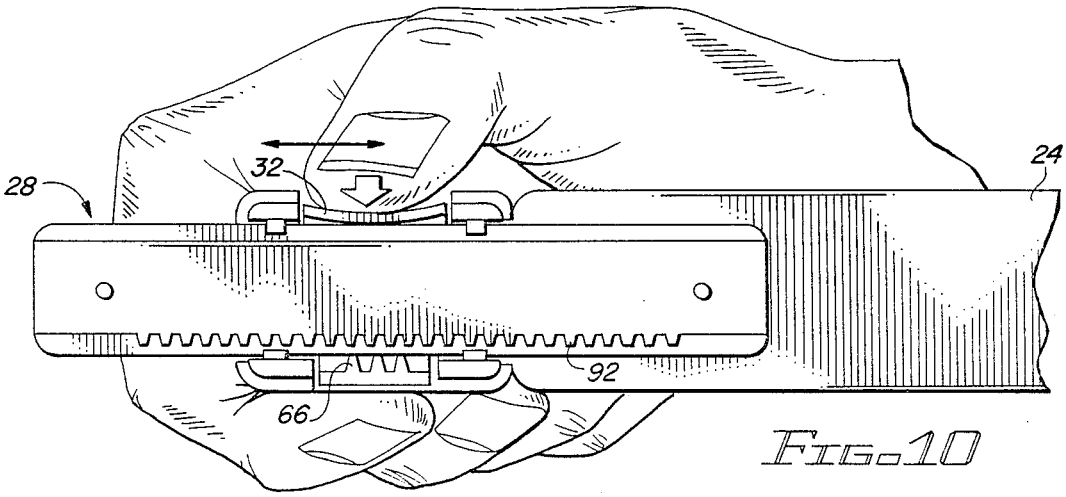
FIG. 10

ADJUSTABLE PORTFOLIO STRAP ARRANGEMENT

FIELD OF THE INVENTION

This invention relates to a brief case of the type containing an expansible portfolio section for holding papers and files and the like. More particularly, it relates to means for holding the portfolio support straps in place.

BACKGROUND OF THE INVENTION

Certain types of brief cases which open like a suitcase, such as attache cases, contain a portfolio section for holding files and the like. The portfolio section generally comprises one or more spaced panels the side edges of which are connected to a flexible gusset. The gussets are connected to the inside of the brief case lid so that upon opening the brief case the portfolio faces the user. The weight of the panels when in this position tends to pull the upper free ends of the panels downwardly so as to open the portfolio. The space between the panels and the space between the inside of the lid and the nearest panel constitute the pockets of the portfolio in which files and other items can be held.

Straps attached to the sides of the lid are adjustably connected to the outer portfolio panel to enable a user to compress the portfolio pockets when they are empty or not very full, or to allow the panels to be separated by the full width of their gussets when the pockets are heavily loaded. Generally each strap contains two holes which are adapted to receive a flanged knob or button extending outwardly from the outermost panel. The hole closest to the free end of the strap is used when the portfolio is heavily loaded and the hole farthest from the free end is used when the portfolio is empty or only lightly loaded. Although such an arrangement is satisfactory when the thickness of the materials in the portfolio pockets approximates the width of the pockets at either extreme of belt adjustment, most of the time the thickness of the items in the pockets is somewhere between the extremes. The result is that the pockets hang down toward the main receptacle portion of the brief case a greater distance than would be desired if the pockets were capable of finer adjustment. This can be annoying to the user and tends to make it more difficult to locate files in the portfolio pockets. Moreover, it presents a sloppy appearance when the brief case is open.

To solve this problem by providing the straps with more holes is not desirable. Most users do not want to have to undo the straps each time they add or take out materials, then locate the correct hole in the straps and reattach the straps to the buttons. Moreover, by providing more button holes in the straps the holes would preferably be made smaller so as to leave enough material between the holes to maintain the strength of the strap, which in turn would necessitate using smaller buttons, thus reducing the holding power of the straps.

Another possible solution would be to make the straps longer and provide additional buttons on the outermost panel spaced so that a greater variety of adjustment settings could be achieved. This would add to the cost of the brief case, however, and would tend to cause the user even more problems in selecting the best combination of holes and buttons.

It would be desirable to provide a simple arrangement for adjusting the extent to which the portfolio pockets can open which does not have the drawbacks of the conventional system described above.

BRIEF SUMMARY OF THE INVENTION

This invention retains the use of a flexible strap to restrict outward movement of the portfolio panels but changes the connection between the strap and the outermost portfolio panel. A track is provided on the outer face of the outermost portfolio panel and a connecting means to which the strap is attached rides on the track. The connecting means is prevented from becoming detached from the track and can be locked in place at any of a number of closely spaced locations along the length of the track, thus enabling a user to adjust the strap according to the amount of material in the portfolio pockets.

In a preferred embodiment the connecting means has locking means, such as teeth, which engage complementary locking means on the track. The locking means of the connecting means are spring biased toward the track and can be released therefrom by movement of a button pushed by a user. The functional elements of the connecting means preferably are part of an integral unitary plastic molded shape which is simple in design and economical to produce. In addition to the improved adjustability of the arrangement, its slim configuration is both attractive and functional, since it takes up so little space when the brief case is closed.

Other features and aspects of the invention, as well as its various benefits, will become more clear in the detailed description of the preferred embodiment which follows.

BRIEF DESCRIPTION OF THE DRAWINGS

FIG. 1 is a pictorial view of a brief case incorporating the portfolio strap connecting and adjusting means of the present invention;

FIG. 2 is a partial enlarged pictorial view of the strap connecting and adjusting means of the present invention;

FIG. 4A is a plan view of the back of a connector assembled from the components of FIG. 3, with the locking means of the insert shown in its normal locked position;

FIG. 6 is a pictorial view of the back of the track;

FIG. 7 is a pictorial view of the front of the track;

FIG. 8 is a back elevational view of the assembled connector shown mounted on the track, the portfolio panel to which the track would be attached being omitted for purpose of clarity;

FIG. 9 is a sectional view taken on line 9—9 of FIG. 8; and

FIG. 10 is a view similar to that of FIG. 8, but showing a user's thumb and fingers depressing the button controlling the locking means.

DESCRIPTION OF THE INVENTION

Figure 4B:
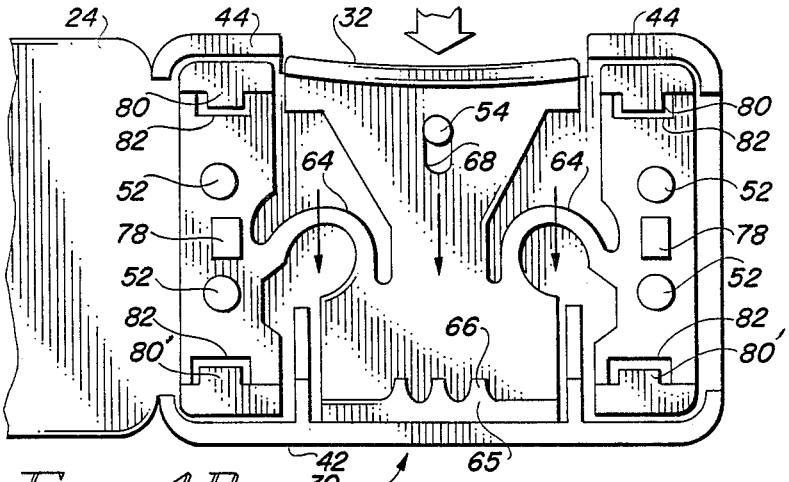
FIG. 4B is a plan view similar to that of FIG. 4A, but showing the locking means in its unlocked position.

Referring to FIGS. 1 and 2 of the drawing, an attache type of brief case 10 has a base or receptacle portion 12 and a lid 14 hingedly connected to the base portion. A portfolio 16 comprises panels 18 and 20, the side edges of which are attached to gussets 22, as by stitching. Although the details of the gusset attachment means are not shown since they do not form part of this invention, it will be understood that the gussets are attached to the side panels of the brief case lid 14 by any of the well known methods in the art. The bottom edge of the outer panel 20 is normally attached to the lid by any suitable means, such as by stitching to a flap which itself is riveted to the bottom panel of lid, and the upper side portions of the outermost panel 20 are held in place by side straps 24.

The description of the brief case of FIGS. 1 and 2 thus far is typical of currently used portfolio type brief cases. Instead of adjusting the position of the side straps by buttons or stems extending through holes in the straps, however, the straps 24 are adjusted by means of connectors or buckles 26 which ride on tracks 28. One end of each of the straps 24 is attached to its associated side wall of the lid 14 and the other end is attached to the connector 26. The tracks 28 are attached to the outer surface of the outermost panel 20 by any suitable means desired, such as by rivets, not shown. Each connector 26 comprises an outer casing 30 and an exposed button 32 extending upwardly from the casing. A locking mechanism inside the casing is designed to be disengaged upon the button 32 being depressed, allowing the connector 26 to be slid along the track 28 in either direction depending upon whether the portfolio is to be expanded or compressed.

Figure 3:
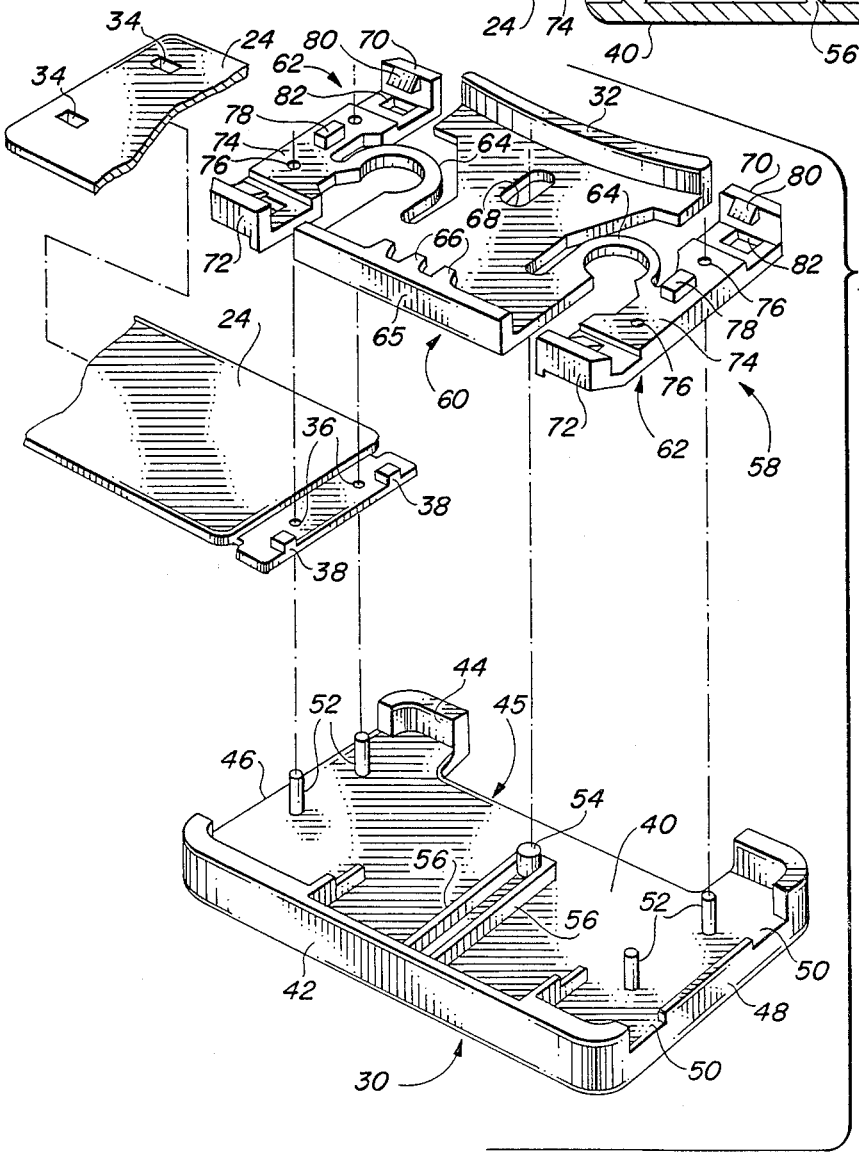
FIG. 3 is an pictorial view of the strap, the connector casing and the connector locking insert in unassembled condition.

Referring to FIG. 3, the strap is of any convenient length to allow the connector to be moved as far toward the center of the panel 20 as desired, which in turn depends upon the design thickness of the portfolio. The end of the strap on the left of FIG. 3 is intended to be connected to the brief case lid 14, which may be accomplished by any suitable means desired. For convenience, slits 34 have been shown, through which staples or other fastening means can extend. The opposite end is configured in a manner permitting the strap to be conveniently attached to the connector 26. As illustrated, the end portion of the strap contains holes 36 located an equal distance on either side of the longitudinal centerline of the strap, and an upwardly extending lug or key 38 is located outwardly of each of the holes 36. The purpose of the holes and the keys will be made clear shortly hereinafter.

Still referring to FIG. 3, the casing 30 comprises an outer or front face 40, a bottom wall 42, top wall portions 44 and side walls 46 and 48. The space between the two top wall portions 44 comprises an opening 45 in the casing through which the button 32 of the locking insert extends in order to be accessible to a user of the portfolio. The side wall 46 is considerably shorter than the adjacent top wall portion 44 and the bottom wall 42 so as to form an opening through which the end of strap 24 can be received. A related although not identical arrangement exists at the other end of the casing where the side wall 48 is considerably shorter than the adjacent top wall portion 44 and the bottom wall 42. In this case the wall 48 contains two spaced grooves 50 for receiving the track 28, as will be explained later. The grooved configuration of wall 48 also conforms to the shape of the adjacent portion of the locking insert, which will also be described hereinafter.

Extending back from the front wall 42 of the casing are two pairs of spaced posts 52 which are employed primarily to secure the locking insert in place. With respect to the posts 52 adjacent the side wall 46, they are also employed to secure the strap 24 in place, the holes 36 in the strap being designed to fit over the posts 52. Also extending back from the front face or wall of the casing is a post 54 located generally centrally of the casing near the opening 45. Extending from the post 54 toward the bottom wall 42 is a pair of rails 56. The function of the post 54 and the rails 56 will be explained below.

Still referring to FIG. 3, the locking insert 58 is seen to comprise an integral unitary construction of suitable molded plastic composition. The insert basically consists of a central locking portion 60 connected to end portions 62 by arcuate portions 64. The arcuate portions are sufficiently slender and flexible and sufficiently strong to allow them to function as springs. The button 32 forms the upper end of the central locking portion 60. The wall 65 forming the opposite lower end of the central locking portion carries three upwardly extending teeth 66. In addition, a slot 68 in the upper part of the locking portion 60 is adapted to fit over the post 54 of the casing so that the post will limit movement of the central locking portion in a transverse direction of the casing 30.

Each end portion 62 comprises upper and lower walls 70 and 72, respectively, and a centrally located platform 74. The spaces between the platform and the walls function as grooves for receiving the flanges of the track, to be described more fully hereinafter. Extending from the platforms 74 are pairs of spaced holes 76 designed to receive the posts 52 of the casing. Located between the holes 76 and extending from the platforms 74 are track guide posts 78, which in the assembled condition are designed to extend back from the front wall of the casing a greater distance than the casing posts 52. Completing the construction of the locking insert are track guide lugs 80, which are shown to extend from the top walls 70 a short distance toward the bottom walls 72, and apertures 82 located adjacent the top and bottom walls. Although not visible in FIG. 3, similar guide lugs extend from the bottom walls 72 and similar apertures are located adjacent the bottom walls. The purpose of the apertures 82 is to receive the lugs or keys 38 of the strap in order to better stabilize the relationship of the strap with respect to the connector 26. Although only the apertures 82 in the end portion 62 adjacent the strap would be used, apertures are provided in both end portions to permit a single locking insert design to be used in both the right and left connectors in a portfolio strap arrangement.

Figure 5:
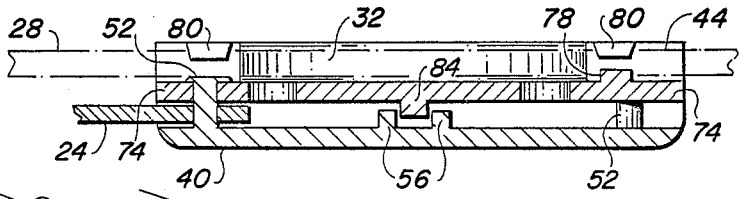
FIG. 5 is a sectional view taken on line 5—5 of FIG. 4A.

The assembled connector is shown in FIGS. 4A and 5, wherein the posts 52 on the left side of FIG. 4A extend through the holes 36 in the strap and the holes 74 in the locking insert, while the posts 52 on the right side of FIG. 4A extend through only the holes 74 in the locking insert. As particularly shown in FIG. 5, the components can be prevented from loosening and separating by swaging the tops of the posts 52 by any suitable means. Since the posts are preferably formed of plastic the material can readily be swaged.

Referring to FIG. 5, the guide lugs 80 can be seen to extend from the top of the walls 44 and a smaller guide lug 84 can be seen to depend from the midpoint of the central locking portion. The guide lug 84 rides between the rails 56 of the casing to maintain the movement of the central locking portion in the proper direction. In addition, the rails 56 function to stiffen the casing to add structural rigidity. It should be understood that although no other stiffening rails or ridges are shown, they could be incorporated into the casing at various locations as needed, so long as they do not interfere with the operation of the locking mechanism and the relative movement between the connector and the track.

As shown in FIG. 4A the bottom wall 65 of the central locking portion 60 is ordinarily spaced from the bottom wall 42 of the casing to maintain the locking insert in its locking position. When it is desired to release the lock so as to be able to move the connector, the button is pressed in the direction of the arrow, as shown in FIG. 4B, causing the central locking portion to move downwardly toward the bottom wall of the casing. The force of the springs 64 is thus overcome, causing the springs to be contorted into the shape shown in FIG. 4B. As soon as the button is released the springs return the central locking portion to its original position shown in FIG. 4A.

Referring now to FIGS. 6 and 7, the track 28 is an elongated strip having a raised central portion 86 and outwardly extending side flanges 88 which function as the rails of the track. As shown best in FIG. 6, the wall 90 connecting the central portion 86 and the flange 88 is provided with a series of regularly spaced teeth 92 designed to cooperate with the teeth on the locking insert previously described. The raised central portion 86 comprises the back side of the track and is provided with outwardly extending posts 94 to assist in attaching the track to the outer panel of a portfolio. The opposite side of the track is hollowed to form a cavity 96 which provides the track with the required cross-sectional shape to permit the connector to slide along the track. The ends of the track are closed by end walls 98 which function as stops to limit the travel of the connector in both directions. It should be understood that the teeth 92 are provided only on the wall 90 corresponding to the bottom wall of the track.

Referring now to FIGS. 8 and 9, it can be seen that the grooves formed between the raised platform 74 of the locking insert and the top and bottom walls 70 and 72, respectively, receive the flanges 88 of the track 28, allowing the connector to be slid along the track in either direction. The wall of the cavity 96 contacts the guide post 78 to maintain the proper relative positions of the track and the connector while the lugs 80 and 80' prevent the removal of the connector from the track. It will be noted that the lugs 80 and 80' have a sloped surface facing away from the track and that the lugs extend over the flanges of the track only a relatively short distance. This arrangement allows the connector to be installed on the track simply by aligning the sloped lug surfaces with the track and forcing the sloped surfaces over the track flanges until the connector snaps onto the track. This is possible due to the dimensions of the lug surfaces and the inherent flexibility of the plastic material of the lugs and track. Once installed the connector cannot be removed since the lug surface facing the track is not sloped.

It will be understood that in the condition shown in FIG. 8 the connector is in locked condition, with the teeth 66 of the locking insert in engagement with the gaps between the teeth 92 of the track. The connector will remain in this location due to the bias of the springs of the locking insert, as explained previously. When it is desired to adjust the pocket size of the portfolio, it is merely necessary to depress the button 32 of the connector, as shown in FIG. 10, to disengage the teeth 66 and 92, and then slide the connector along the track to the desired new location. It should be remembered in connection with this description that FIGS. 8 and 10 show the back of the track and connector, the portfolio panel to which the track would be attached having been removed for purpose of clarity. The user of the adjustable connector thus would not be able to see the teeth and other components of the locking mechanism shown in FIGS. 8 and 10.

It should now be clear that the present invention provides a simple, inexpensive and efficient means for adjusting the pocket thickness of a portfolio. The thickness can be adjusted to any of a large number of locations, limited only by the number of teeth in the track. The connector or buckle, even with the functional capabilities described above, is comprised of only two molded plastic components, and present a trim, sleek appearance. Moreover, it is simple to use, the button of each of the two connectors on the portfolio preferably being depressed at the same time by the user's thumbs and slid to the new desired locations.

Although the locking insert has been described as comprising three teeth to intermesh with the teeth on the track, obviously any desired number can be used so long as the engagement of the teeth is sufficient to maintain the connector in a stable locked condition. Further, although the insert and the casing have been described as embodying features which facilitate their assembly, obviously other methods of assembly exist, which if used would require such features to be eliminated or modified.

Although the track has been described as extending part way across the width of the portfolio panel, it could just as well extend all the way across if desired.

Also, lugs 80' could be removed or reduced to permit the buckle to be uncoupled and lifted from the track when the button 32 is depressed to disengage the teeth 92 from the track, as illustrated in FIG. 10 for example. In conjunction with this operation, the teeth 66 could also be provided with tapered front surfaces much like those on lugs 80 and 80' to facilitate remounting of the buckle on the track.

It should now be obvious that although a preferred embodiment of the invention has been described, changes to specific details of the embodiment can be made without departing from the spirit and scope of the invention as defined in the claims

What is claimed is:

1. In a brief case including lid means having an inside surface and portfolio means, wherein the portfolio means comprises at least one panel spaced from the inside surface of the lid means and wherein movement of the panel away from said inside surface is restricted by strap means connecting the panel and the lid means, an improved strap means comprising:

a flexible strap attached at one end to the lid means;

a track on the face of the panel facing away from the inside surface of the lid means;

means attached to the other end of the flexible strap and connected to the track in movable relationship thereto;

means preventing the connecting means from becoming detached from the track; and means permitting the connecting means to be locked in place at any of a plurality of locations along the length of the track.

2. In a brief case according to claim 1, wherein the means permitting the connecting means to be locked in place along the length of the track comprises first locking means on the track extending along a substantial portion of the length thereof, and second locking means complementary to the first locking means mounted on the connecting means for movement toward and away from the first locking means, and means for holding the first and second locking means in locking engagement.

3. In a brief case according to claim 2, wherein the means for holding the second locking means in locking engagement with the first locking means comprises spring means biasing the second locking means toward the first locking means.

4. In a brief case according to claim 3, wherein the connecting means comprises a casing slidably mounted on the track, the second locking means being mounted for movement transversely of the length of the track, and the spring means connecting the second locking means and the casing.

5. In a brief case according to claim 4, wherein the track has a face facing the casing and wherein the transverse movement of the second locking means is generally parallel to the face of the track.

6. In a brief case according to claim 4, including means on the second locking means accessible to a user of the portfolio means and enabling the user to push the second locking means against the bias of the spring means out of engagement with the first locking means, thereby freeing the casing for slidable movement along the track.

7. In a brief case according to claim 6, wherein the first locking means comprises a plurality of spaced teeth and the second locking means comprises at least one tooth adapted to fit between adjacent teeth of the first locking means.

8. In a brief case according to claim 7, wherein the second locking means comprises a plurality of teeth.

9. In a brief case according to claim 4, wherein the second locking means and the spring means are components of an integral unitary configuration of plastic material, the spring means comprising a relatively thin arcuate portion.

10. In a brief case according to claim 9, including means connecting the second locking means and the casing for guiding the transverse movement of the second locking means and limiting the transverse movement of the second locking means both toward and away from the first locking means.

11. In a brief case according to claim 4, wherein the track includes a recess extending along the portion of the track over which the casing can slide, and including stop means at the ends of the recess, the stop means preventing further movement of the casing.

12. In a brief case according to claim 1, wherein the track has at least one elongated flange at an edge thereof, and wherein the means preventing the connecting means from becoming detached from the track comprises at least one projection overlying the elongated flange of the track, the projection also serving to guide the relative movement of the connecting means and the track.

13. In a brief case according to claim 12, wherein the projection extends over only a relatively small portion of the track and wherein the projection has a sloped surface facing away from the track, enabling the connecting means to be mounted on the track by initially contacting the sliding surface of the track with the sloped surface of the projection and pushing the connecting means against the track until the projection snaps past the track and into place on the other side of the track.

14. In a brief case including lid means having an inside surface and portfolio means, wherein the portfolio means comprises at least one panel spaced from the inside surface of the lid means and wherein movement of the panel away from said inside surface is restricted by strap means connecting the panel and the lid means, an improved strap means comprising:

a flexible strap attached at one end to the lid means;

a track on the face of the panel most remote from the inside surface of the lid means;

buckle means connected to the other end of the strap;

the buckle means comprising a casing movably connected to the track;

spring means connected to the casing;

locking means connected to the spring means and being urged by the spring means into locking engagement with the track; and means permitting the locking means to be moved out of locking engagement with the track to enable a user of the portfolio means to slide the casing to a different location on the track in order to adjust the location of the other end of the strap with respect to the portfolio panel.

15. In a brief case according to claim 14, wherein the means permitting the locking means to be moved out of locking engagement with the track comprises button means connected to the locking means and being accessible to the finger or thumb of a user of the portfolio means, whereby a user can press the button to move the locking means against the urging of the spring means and out of engagement with the track.

16. In a brief case according to claim 14, wherein the track extends a substantial distance from both side edges of the panel toward the other side edge and wherein the improved strap means are provided at each side edge of the panel.

17. A fastening arrangement for adjustably securing together first and second relatively movable members, comprising:

a buckle attached to the first member and being slidably mounted on the second member;

the second member having side edges and an outer face facing the buckle;

first locking means on the second member adjacent a side edge thereof;

second locking means mounted in the buckle for movement transversely of the direction of relative movement between the first and second members and generally parallel to the outer face of the second member;

the second locking means being adapted to engage the first locking means to lock the first and second members against relative movement;

spring means mounted in the buckle for biasing the second locking means toward the first locking means; and means mounted in the buckle for moving the second locking means against the bias of the spring out of engagement with the first locking means to allow the buckle to be moved to a different location on the second member.

18. A fastening arrangement according to claim 17, wherein the first locking means comprises a plurality of spaced teeth and the second locking means comprises at least one tooth adapted to fit between adjacent teeth of the first locking means.

19. A fastening arrangement according to claim 18, wherein the second member has at least one elongated flange at an edge thereof, and wherein the means preventing the buckle from becoming detached from the second member comprises lug means on the buckle extending over at least a portion of the elongated flange of the second member, the plurality of spaced teeth being adjacent the elongated flange and the teeth of the second locking means also extending over the elongated flange when the tooth is engaged with the spaced teeth of the first locking means.

20. A fastening arrangement according to claim 17, wherein the second locking means and the spring means are components of an integral configuration of plastic material, the spring means comprising a relatively thin arcuate portion, the second locking means and the spring means being attached to the buckle so as to allow controlled movement of the second locking means and the spring means as the second locking means moves in and out of engagement with the first locking means.

* * * * *